US006815941B2

(12) United States Patent
Butler

(10) Patent No.: US 6,815,941 B2
(45) Date of Patent: Nov. 9, 2004

(54) BANDGAP REFERENCE CIRCUIT

(75) Inventor: Douglas Blaine Butler, Colorado Springs, CO (US)

(73) Assignees: United Memories, Inc., Colorado Springs, CO (US); Sony Corporation, Tokyo (JP)

( * ) Notice: Subject to any disclaimer, the term of this patent is extended or adjusted under 35 U.S.C. 154(b) by 0 days.

(21) Appl. No.: 10/358,668

(22) Filed: Feb. 5, 2003

(65) Prior Publication Data

US 2004/0150381 A1 Aug. 5, 2004

(51) Int. Cl.[7] ..... G05F 3/16
(52) U.S. Cl. ..... 323/313; 323/316; 323/901
(58) Field of Search ..... 323/313, 314, 323/315, 316, 901

(56) References Cited

U.S. PATENT DOCUMENTS 4,396,883 A 8/1983 Holloway et al.
4,931,718 A 6/1990 Zitta
5,545,978 A 8/1996 Pontius
6,018,235 A * 1/2000 Mikuni ..... 323/313
6,031,365 A * 2/2000 Sharpe-Geisler ..... 323/313
6,052,020 A * 4/2000 Doyle ..... 327/539
6,084,388 A 7/2000 Toosky
6,150,872 A 11/2000 McNeill et al.
6,373,330 B1 4/2002 Holloway
6,384,586 B1 * 5/2002 Sugawara ..... 323/313
6,507,179 B1 * 1/2003 Jun et al. ..... 323/313
6,507,180 B2 * 1/2003 Eguchi ..... 323/314
6,608,472 B1 * 8/2003 Kutz et al. ..... 323/313
6,724,176 B1 * 4/2004 Wong et al. ..... 323/316

* cited by examiner

*Primary Examiner*—Jeffrey Sterrett
(74) *Attorney, Agent, or Firm*—Peter J. Meza; William J. Kubida; Hogan & Hartson LLP

(57) ABSTRACT

A bandgap reference circuit includes a current-voltage mirror circuit having first, second, third, and fourth nodes, a transistor having a current path coupled between a source of supply voltage and the first node, a current mirror portion having an input coupled to the first node and a control terminal coupled to the fourth node, a serially coupled first resistor and first diode coupled between the output of the current mirror portion and ground, a serially coupled second resistor and second diode coupled between the third node and ground, a third diode coupled between the second node and ground, and a differential amplifier having a first input coupled to the fourth node, a second input coupled to the output of the current mirror portion for generating a bandgap reference voltage, and an output coupled to the gate of the transistor.

20 Claims, 5 Drawing Sheets

BANDGAP REFERENCE CIRCUIT

FIELD OF THE INVENTION

The field of the present invention is related to integrated circuit reference voltage generator circuits and more particularly to bandgap voltage generator circuits.

BACKGROUND OF THE INVENTION

A voltage level independent of temperature, supply voltage and process variations, or reference voltage, is desirable for many integrated circuit applications. A well known method of generating such a reference voltage is referred to as a "bandgap reference" since this circuit relies on the bandgap of silicon as the basis for the reference voltage.

The bandgap of silicon determines both the voltage drop across a forward biased diode and the slope of the current-voltage curve of a forward biased diode. These values are predictable and are not subject to process variations and are thus suitable for a generating a generally stable reference voltage.

The voltage drop across a forward biased diode decreases as the temperature of the diode increases. The voltage increase required for increasing the current flowing through a diode by a factor of ten increases as the temperature increases. A bandgap reference voltage generator is able to achieve a constant voltage as temperature changes by offsetting one of these effects with the other. To offset one diode drop's voltage variation with temperature, the voltage variation caused by about a $10^{10.5}$ change in current must be used. Diodes are not typically linear over so large a current change so methods that multiply a current change value are usually used.

A bandgap circuit can be achieved by using a current-voltage mirror to force the same current and voltage into legs one and two of a circuit and a current mirror to force the same current into a third leg of a circuit. The first leg of the circuit is a diode forward biased to ground, the second leg of the circuit is a resistor in series with a forward biased diode to ground, the diode in the second leg being ten times the size of the diode in the first leg. The voltage developed across the resistor is a function of only the slope of the forward biased diode current-voltage curve assuming the current voltage mirror functions perfectly. The third leg of the circuit is a resistor in series with a forward biased diode to ground. The resistor in the third leg has about 10.5× the resistance of the resistor in the second leg and the diode in the third leg is the same as the diode in the first leg. The voltage across the third leg is a temperature, process and supply voltage independent voltage, assuming that the current-voltage mirror and current mirror function independently of temperature, process and supply voltage variations.

Referring now to FIG. 1, a combined block and schematic diagram of prior art bandgap reference voltage circuit 10 is shown. In the circuit 10 of FIG. 1, PMOS transistors 127,129 and 131 are identical. PMOS transistors 127 and 129 form a current mirror circuit that is coupled with NMOS transistors 128 and 130 that form a modified current mirror circuit (note that the source are not coupled together) in order to form a "current-voltage" mirror circuit 12 as shown. Transistor 131 is a current mirror portion 14 for mirroring the current flowing in PMOS transistors 127 and 129.

PNP bipolar transistors 111 and 113 are identical in terms of emitter area. Note that transistors 111, 112, and 113 are all diodes formed using diode-connected transistors wherein the collector is shorted to the base of the transistor as is known in the art. PNP bipolar transistor 112 has 10× the emitter area or alternately is ten transistors identical to transistor 111 wired in parallel.

The current-voltage mirror forces the current through 111 to be equal to the current through 112. The current-voltage mirror also forces the source voltage of 130 to be equal to the source voltage of 128. Such current-voltage mirror circuits depend on the transistors thereof to be operating in saturation as transistors operating in saturation conduct current substantially independent of the source to drain voltage. A 60 K ohm resistor is coupled in series between transistor 112 and the current-voltage mirror circuit 12 and a 630K ohm resistor is coupled in series between transistor 113 and the current mirror portion 14.

A capacitor 181 is coupled to the VREG output voltage. The capacitor is formed using an NMOS transistor 181 configured in a capacitor-connected configuration in which the gate forms the one electrode of the capacitor and the coupled source and drain forms the other electrode of the capacitor as is known in the art.

The voltage drop across diode 111 is equal to the voltage drop across diode 112 plus the voltage drop across resistor 160. The current through diode 111 is equal to the current through diode 112 but since the size of diode 112 is ten times larger than diode 111, the current density is ten times higher in diode 111 than in diode 112. Therefore, the voltage drop across diode 111 is higher than the voltage drop across diode 112 by an amount that is equivalent to a factor of ten current change. This difference in the voltage drop across diodes 111 and 112 increases as temperature increases and is therefore referred to as a Voltage Proportional To Absolute Temperature or VPTAT. It also follows that the voltage drop across resistor 160 is also a VPTAT.

Transistor 131 acts as a portion 14 of a current mirror in conjunction with the current-voltage mirror circuit 12 and attempts to force the same current through diode 113 as is being forced by the current-voltage mirror circuit 12 through diodes 111 and diode 112. To the extent that the currents through diodes 111, 112 and 113 are matched, the voltage drop across resistor 170 is 10.5×VPTAT. The voltage drop across diode 113 is a forward biased diode voltage. The output reference voltage at the drain of transistor 131 is designated "VBG" (for BandGap Voltage) and is the sum of the two voltages and is therefore relatively independent of temperature as the change of voltage of a diode drop is approximately equal to the change of voltage of 10.5× VPTAT but opposite in sign.

Differential amplifier 16 controls the gate of PMOS transistor 126 so that the output reference voltage VREG is regulated to the voltage at which the gate voltage of 128/129 is equal to the gate voltage of 128/130. This assures that PMOS transistors 127 and 129 are operating at substantially identical voltage conditions and VBG variations are eliminated due to increasing the VCCX supply voltage above this regulation point.

It can be seen that VREG output voltage is controlled to PVt+NVt+ a forward biased diode drop, wherein PVt is the threshold voltage of a PMOS transistor and NVt is the threshold voltage of an NMOS transistor. As NVt and PVt decrease, VREG approaches VBG, reducing the VDS across transistor 131. In the extreme case of very low NVt and PVt, VREG can be below the desired VBG reference voltage resulting in an undesirable VBG variation with NVt and PVt.

Referring now to FIG. 4, the undesirable variations in the VBG voltage with respect to the VCCX power supply voltage are shown, plotted at several different temperature and operating conditions. The SPICE simulation results for the bandgap reference voltage circuit 10 are shown in FIG. 4. Simulations were done at temperatures of −10° C., 25° C. and 105° C. The transistor models used were typical for NMOS and PMOS (IT) slow for both (SS) and fast for both (FF). In addition corner models were used, fast NMOS, slow PMOS (FNSP) and slow NMOS and fast PMOS (SNFP). The variation of slow or fast models corresponds to approximately three sigma process variations. An undesirable VBG variation of about 130 mV was seen over all simulated conditions.

What is desired, therefore, is a bandgap reference voltage circuit that is more immune to process and temperature variations, yet takes advantage of the generally stable reference voltage generated by a typical prior art bandgap generator circuit.

SUMMARY OF THE INVENTION

According to the present invention a bandgap reference circuit includes a current-voltage mirror circuit having first, second, third, and fourth nodes, a transistor having a current path coupled between a source of supply voltage and the first node, a current mirror portion having an input coupled to the first node and a control terminal coupled to the fourth node, a serially coupled first resistor and first diode coupled between the output of the current mirror portion and ground, a serially coupled second resistor and second diode coupled between the third node and ground, a third diode coupled between the second node and ground, and a differential amplifier having a first input coupled to the fourth node, a second input coupled to the output of the current mirror portion for generating a bandgap reference voltage according to the present invention, and an output coupled to the gate of the transistor.

The current-voltage mirror includes a PMOS current mirror having an input coupled to the fourth node, and a source terminal coupled to the first node, as well as an NMOS current mirror having an input coupled to the output of the PMOS current mirror, an output coupled to the fourth node, a first source terminal forming the second node, and a second source terminal forming the third node. The current mirror portion includes a PMOS transistor having a gate forming the control terminal, a drain forming the output, and a source forming the input. The differential amplifier includes a single-ended output, a PMOS load circuit, a first NMOS transistor having a gate forming the first input, a drain coupled to the PMOS load circuit, and a source, a second NMOS transistor having a gate forming the second input, a drain coupled to the PMOS load circuit, and a source, and a third NMOS transistor having a drain coupled to the sources of the first and second NMOS transistors, a gate for receiving a bias voltage, and a source coupled to ground. The bandgap reference circuit also includes a start-up circuit coupled to the gate of the transistor, as well as to the first and second inputs and output of the differential amplifier.

It is a major advantage of this invention that about a factor of ten reduction in the bandgap reference voltage variation due to NMOS and PMOS transistor variations can be achieved.

This invention discloses a bandgap circuit having an output bandgap reference voltage that is substantially independent of temperature, process and supply voltage variations.

DETAILED DESCRIPTION OF DRAWINGS

These and other objects, advantages, and features of the present invention are more readily understood from the following detailed description of the invention when considered in conjunction with the accompanying drawings in which.

DETAILED DESCRIPTION

Figure 1:
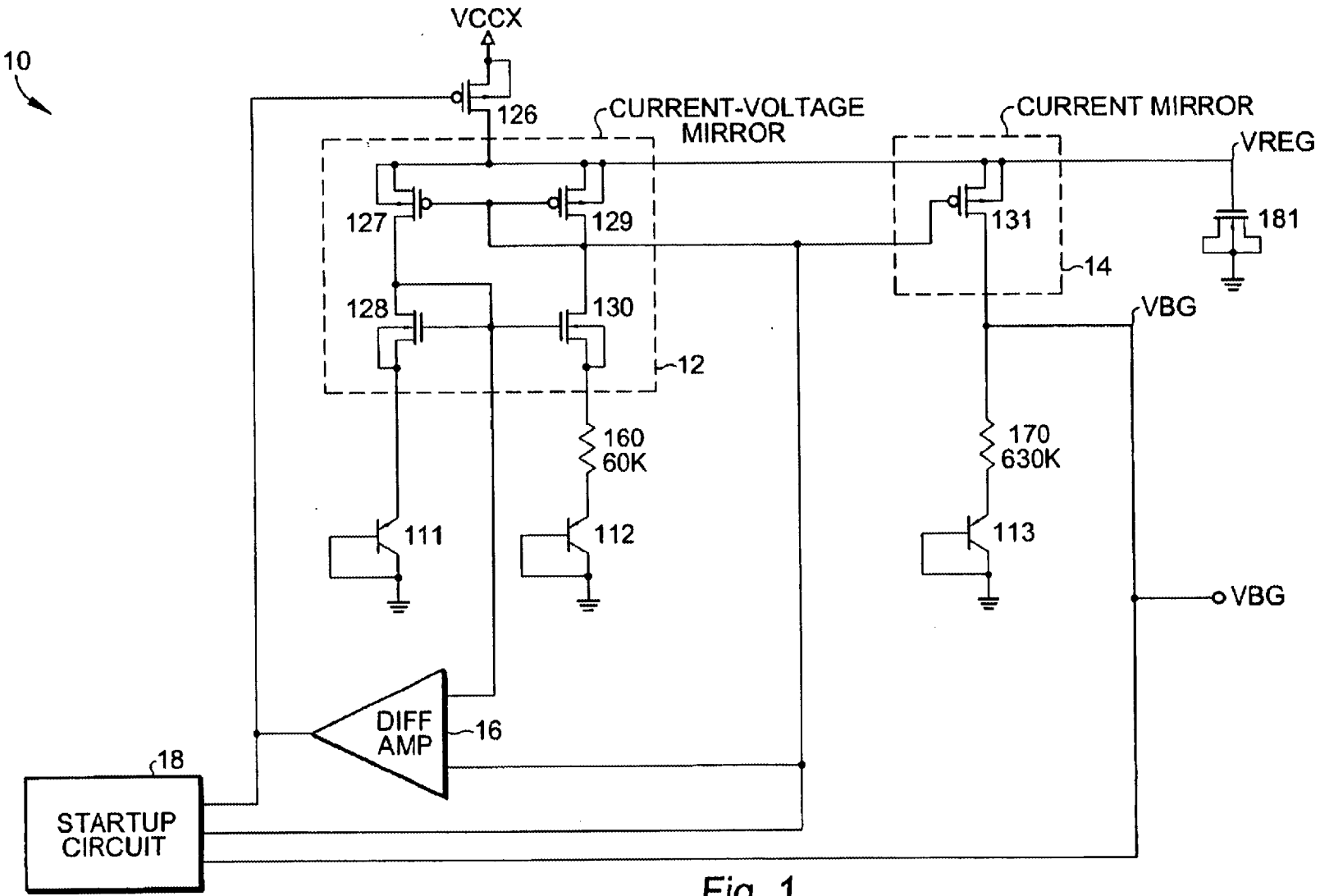
Fig. 1 Prior Art
FIG. 1 is a combined transistor-level schematic and block diagram of a prior art bandgap reference circuit.
Figure 2:
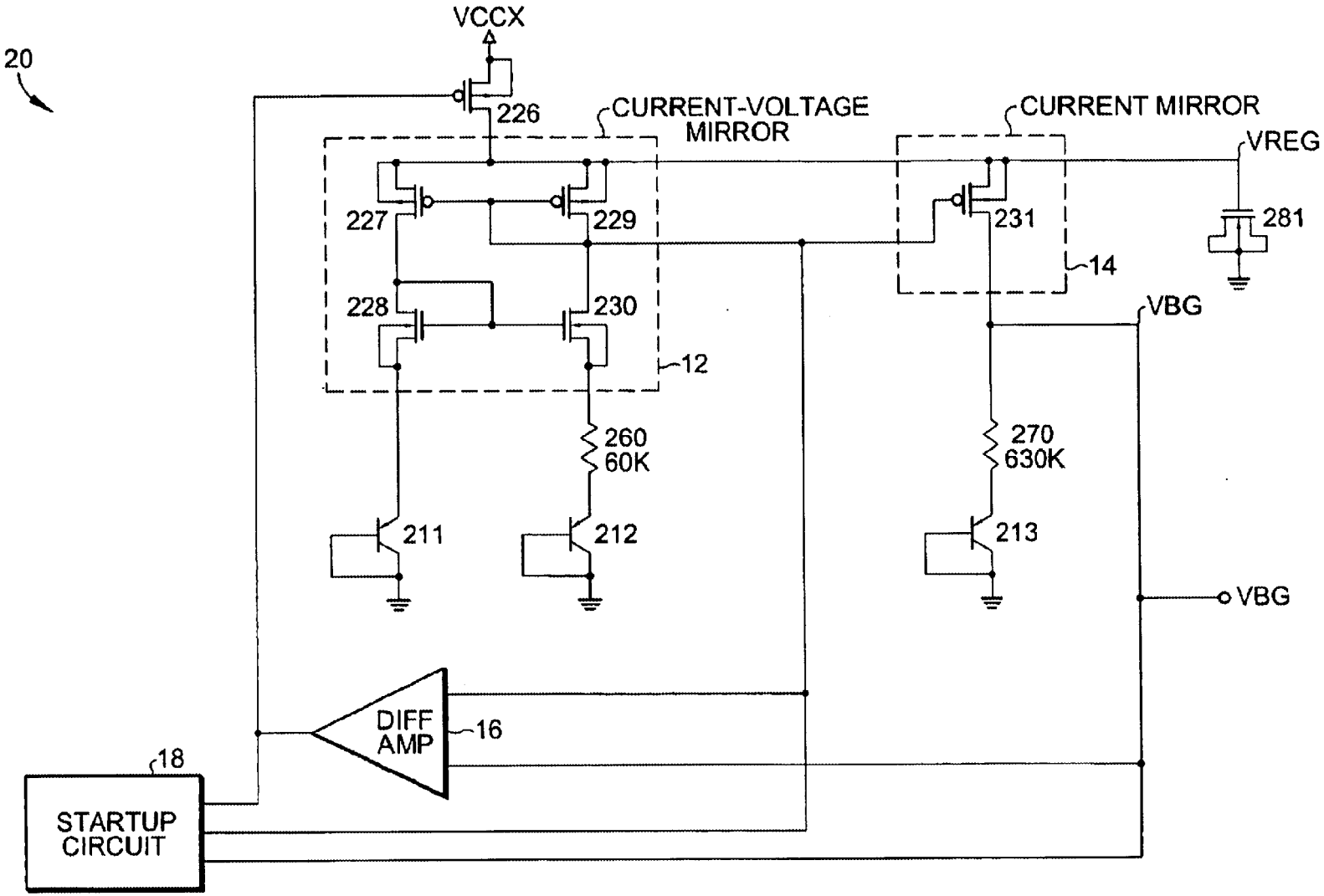
FIG. 2 is a combined transistor-level schematic and block diagram of a bandgap reference circuit according to the present invention.

Referring now to FIG. 2, a band gap reference circuit 20 according to the present invention is shown. The circuit topology of the prior art reference circuit 10 has been modified as is described in detail below. To understand the present invention it is important to note the difference between the input connections for differential amplifier 16 in the prior art circuit of FIG. 1, and the input connections for differential amplifier 16 of the present invention shown in FIG. 2. The connections for differential amplifier 16 in FIG. 2 causes the VREG voltage to be controlled such that the voltage on the fourth node of the current-voltage mirror 12 is equal to VBG. In contrast, the connections for differential amplifier 16 in the prior art FIG. 1 causes the VREG voltage to be controlled such that the voltage on the fourth node of the current-voltage mirror 12 is equal to the voltage on the gates of transistors 128/130. This difference results in a more stable VBG reference voltage over process and temperature variations in that the operating conditions of transistors 229 and 231 are forced to be as identical as can be achieved by the action of differential amplifier 16 and transistor 226.

In FIG. 2, PMOS transistors 227, 229 and 231 are the same size. Diode-connected bipolar transistors 211 and 213 have the same emitter area. Bipolar transistor 212 has ten times the emitter area or alternately is ten transistors each having the same emitter area as transistor 211 wired in parallel.

The current-voltage mirror circuit 12 forces the current through diode 211 to be equal to the current through diode 212. The current-voltage mirror circuit 12 also forces the source voltage of transistor 230 to be equal to the source voltage of transistor 228. Current-voltage mirror circuit 12 and similar circuits depend on the transistors thereof to be operating in saturation. This is because transistors operating in saturation conduct current substantially independent of the source to drain voltage (VDS).

The voltage drop across diode 211 is equal to the voltage drop across diode 212 plus the voltage drop across resistor 260. The current through diode 211 is equal to the current through diode 212, but since the size of diode 212 is ten times larger than diode 211, the current density is ten times higher in diode 211 compared to diode 212. Therefore, the voltage drop across diode 211 is higher than the voltage drop across diode 212 by an amount that is equivalent to a factor of ten current change. This difference in the voltage drop across diodes 211 and 212 increases as temperature increases and is therefore referred to as a voltage proportional to absolute temperature or VPTAT. It also follows that the voltage drop across resistor 260 is a VPTAT.

Transistor 231 acts as a portion 14 of a current mirror and attempts to force the same current through transistor 213 as is being forced by the current-voltage mirror circuit 12 through diodes 211 and 212. To the extent that the currents through diodes 211, 212 and 213 are matched, the voltage drop across resistor 270 is 10.5×VPTAT. The voltage drop across diode 213 is a forward biased diode junction voltage. The VBG output reference voltage at the drain of transistor 231 is the sum of the two and is therefore relatively independent of temperature as the change of voltage of a diode drop is approximately equal to the change of voltage of 10.5×VPTAT, but opposite in sign.

The differential amplifier 16 controls the gate of PMOS transistor 226 so that VREG is regulated to the voltage at which the drain voltage of PMOS transistor 229 is substantially equal to the drain voltage of transistor 231. This assures that the current through diode 212 is very well matched to the current through diode 213.

It can now be seen that the VREG reference voltage is controlled to VBG+PVt. According to the present invention, as the VCCX power supply voltage is increased, the voltage to the source of PMOS transistors 227, 229 and 231 is regulated so that the drain voltage of 229 is approximately equal to the drain voltage of 231. This assures that the current through diode 212 is equal to the current through diode 213, assuming that the size of transistor 229 is equal to that of transistor 231. The present invention thereby minimizes any difference in current through the first resistor 270 and the second resistor 260. In contrast, the prior art circuit shown in FIG. 1 minimized the difference in current between diodes 111 and 112.

Figure 3:
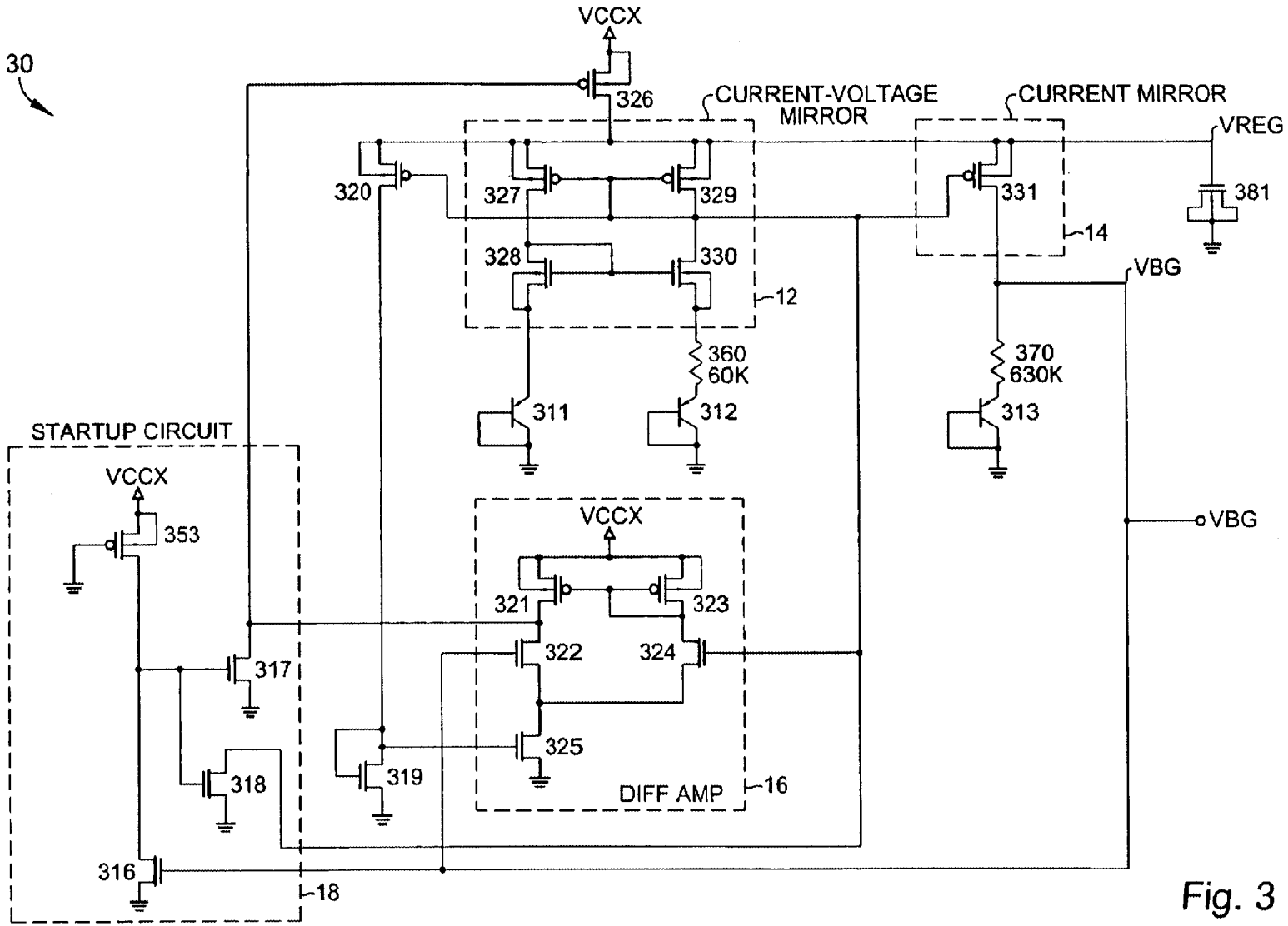
FIG. 3 is a transistor-level schematic of a bandgap reference circuit according to the present invention that sets forth the blocks of FIG. 2 in greater detail.
Figure 4:
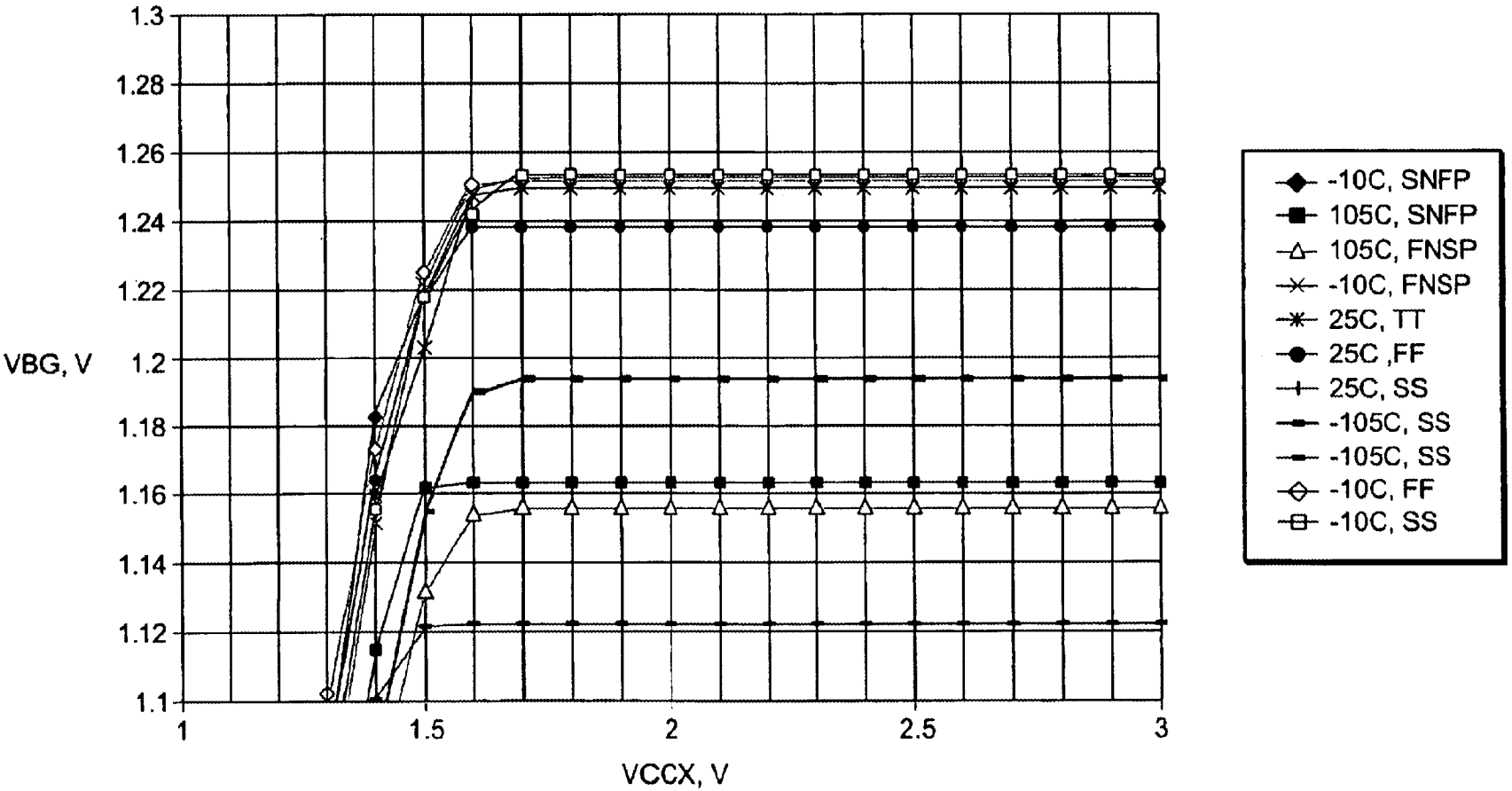
Fig. 4 Prior Art
FIG. 4 is a plot of the performance characteristics of the prior art bandgap circuit of FIG. 1.

Referring now to FIG. 3, equivalent bandgap circuit 30 is shown at the transistor level, thus revealing further details of differential amplifier 16, the startup circuit 18, as well as a bias circuit including PMOS transistor 320 and NMOS transistor 319. Circuit 30 of FIG. 3 is functionally identical to circuit 20 of FIG. 2 but shows a specific transistor-level implementation of the startup circuit 18 and the differential amplifier 16. Differential amplifier 16 includes an NMOS differential input stage including transistors 322 and 324. The gates of transistors 322 and 324 form the positive and negative inputs of differential amplifier 16. A PMOS active load circuit including transistors 321 and 323 is coupled between the VCCX supply voltage source and the drains of transistors 322 and 324. The source current for transistors 322 and 324 is provided by the drain of NMOS transistor 325. The gate bias voltage for transistor 325 is provided by the bias circuit including diode-connected NMOS transistor 319 and the PMOS transistor 320, which mirrors the current flowing through the current-voltage mirror circuit 12 and replicates that current through NMOS transistor 325. The startup circuit 18 includes a PMOS transistor 353, as well as NMOS transistors 316, 317, and 318. The gate of transistor 316 is coupled to the gate of transistor 322. The drain of transistor 317 is coupled to the gate of transistor 326 as well as to the drain of transistor 322. The drain of transistor 318 is coupled to the gate of transistor 324. The function of the startup circuit 18 is to provide a non-zero initial operating condition for bandgap reference circuit 30.

Figure 5:
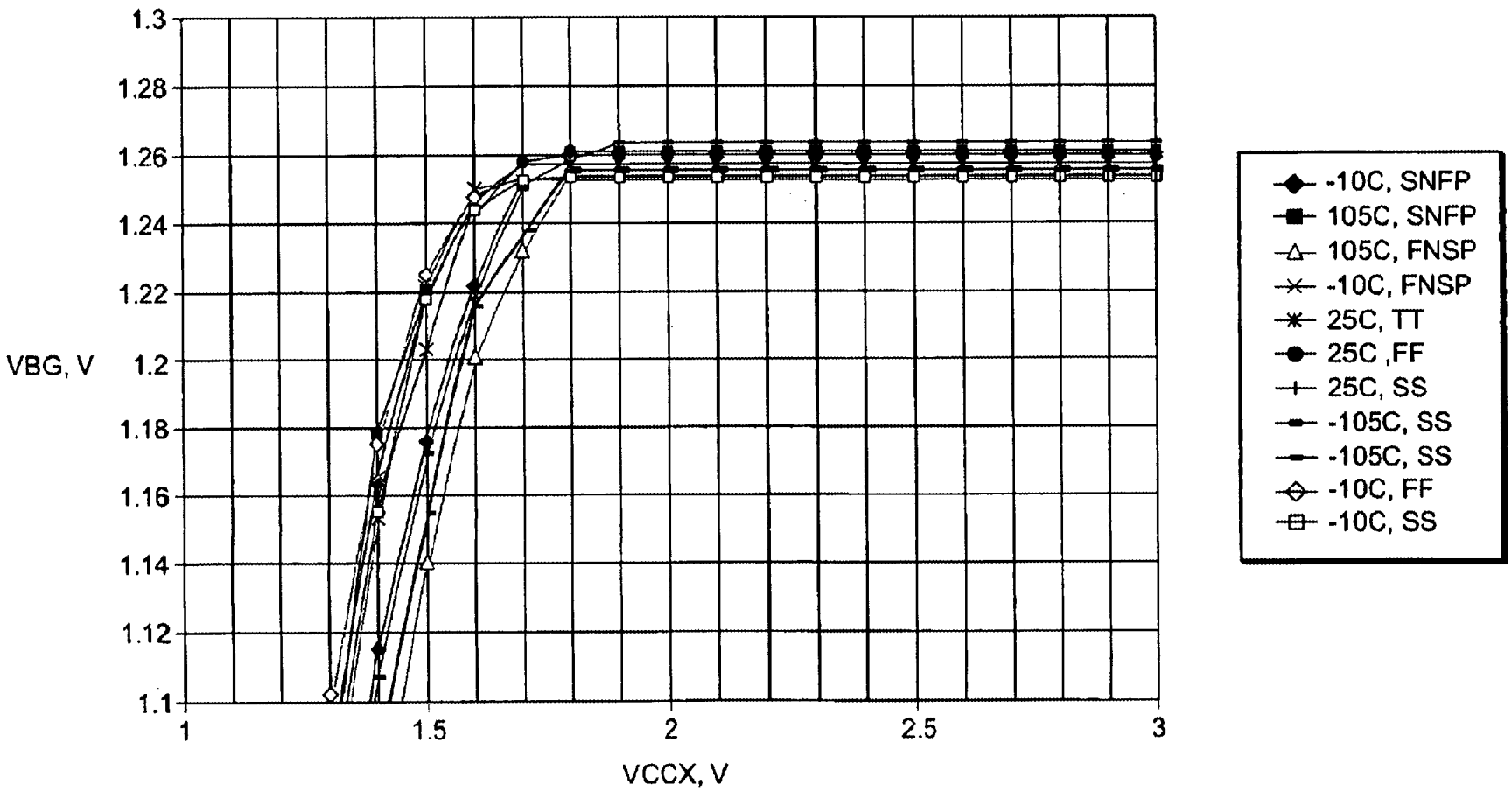
FIG. 5 is a plot of the improved performance characteristics of the bandgap circuits of FIGS. 2 and 3, according to the present invention.

Referring now to FIG. 5, a SPICE simulation of circuits 20 and 30 shown in FIGS. 2 and 3, respectively, are shown. A clear improvement in the variability of the VBG output reference voltage is shown. Simulations were done at temperatures of −10° C., 25° C. and 105° C. The transistor models used were typical for NMOS and PMOS (TT); slow for both (SS) and fast for both (FF). In addition, corner models were used, fast NMOS, slow PMOS (FNSP) and slow NMOS and fast PMOS (SNFP). The variation of slow or fast models corresponds to approximately three sigma process variations.

A much improved VBG output reference voltage variation of about only 10 mV was seen over all simulated conditions.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. A bandgap reference circuit comprising:

a current-voltage mirror circuit having first, second, third, and fourth nodes;

a transistor having a gate, and a current path coupled between a source of supply voltage and the first node;

a current mirror portion having an input coupled to the first node, a control terminal coupled to the fourth node, and an output;

a serially coupled first resistor and first diode coupled between the output of the current mirror portion and ground;

a serially coupled second resistor and second diode coupled between the third node and ground;

a third diode coupled between the second node and ground; and a differential amplifier having a first input coupled to the fourth node, a second input coupled to the output of the current mirror portion for generating a bandgap reference voltage, and an output coupled to the gate of the transistor.

2. A bandgap circuit as in claim 1 in which the current-voltage mirror comprises:

a PMOS current mirror having an input coupled to the fourth node, an output, and a source terminal coupled to the first node; and an NMOS current mirror having an input coupled to the output of the PMOS current mirror, an output coupled to the fourth node, a first source terminal forming the second node, and a second source terminal forming the third node.

3. A bandgap circuit as in claim 1 in which the current mirror portion comprises a PMOS transistor having a gate forming the control terminal, a drain forming the output, and a source forming the input.

4. A bandgap circuit as in claim 1 in which the differential amplifier comprises:

a PMOS load circuit;

a first NMOS transistor having a gate forming the first input, a drain coupled to the PMOS load circuit, and a source;

a second NMOS transistor having a gate forming the second input, a drain coupled to the PMOS load circuit, and a source; and a third NMOS transistor having a drain coupled to the sources of the first and second NMOS transistors, a gate for receiving a bias voltage; and a source coupled to ground.

5. A bandgap circuit as in claim 4 further comprising a bias circuit having an input coupled to the fourth node and an output for generating the bias voltage.

6. A bandgap circuit as in claim 5 in which the bias circuit comprises:

a PMOS transistor having a gate forming the input, a source coupled to the first node, and a drain; and a diode-connected NMOS transistor having an anode coupled to the drain of the PMOS transistor for generating the bias voltage, and a cathode coupled to ground.

7. A bandgap circuit as in claim 1 further comprising a capacitor coupled between the first node and ground.

8. A bandgap circuit as in claim 7 in which the capacitor comprises a capacitor-connected NMOS transistor.

9. A bandgap circuit as in claim 1 further comprising a start-up circuit coupled to the gate of the transistor, as well as to the first and second inputs and output of the differential amplifier.

10. A bandgap circuit as in claim 9 in which the start-up circuit comprises:

a PMOS transistor having a source coupled to the source of supply voltage, a gate coupled to ground, and a drain;

a first NMOS transistor having a gate coupled to the drain of the PMOS transistor, a source coupled to ground, and a drain coupled to the differential amplifier;

a second NMOS transistor having a gate coupled to the drain of the PMOS transistor, a source coupled to ground, and a drain coupled to the differential amplifier; and a third NMOS transistor having a drain coupled to the drain of the PMOS transistor, a source coupled to ground, and a gate coupled to the differential amplifier.

11. A bandgap circuit as in claim 1 in which:

the current-voltage mirror comprises a pair of PMOS transistors; and the current mirror portion comprises a PMOS transistor; and wherein the size of the PMOS transistors in the current-voltage mirror and the current mirror portion are substantially the same.

12. A bandgap circuit as in claim 1 in which the second and third diodes each comprises diode-connected bipolar PNP transistors having substantially the same emitter size.

13. A bandgap circuit as in claim 12 in which the first diode comprises a diode-connected bipolar PNP transistor having substantially ten times the emitter area of the second and third diodes.

14. A bandgap circuit as in claim 12 in which the first diode comprises a diode-connected bipolar PNP transistor including ten parallel transistors each having substantially the same emitter area of the second and third diodes.

15. A bandgap circuit as in claim 1 in which the first resistor has substantially 10.5 times the resistance of the second resistor.

16. A bandgap circuit as in claim 1 in which the resistance of the first resistor is substantially equal to 630K ohms.

17. A bandgap circuit as in claim 1 in which the resistance of the second resistor is substantially equal to 60K ohms.

18. A bandgap reference circuit comprising:

a current-voltage mirror circuit for generating a reference voltage;

a current mirror portion coupled to the current-voltage mirror circuit;

a serially coupled first resistor and first diode coupled to the current mirror portion;

a serially coupled second resistor and second diode coupled to the current-voltage mirror circuit;

a third diode coupled to the current-voltage mirror circuit; and a differential amplifier having a first input coupled to the current-voltage mirror circuit and an output coupled to the current-voltage mirror circuit through an intervening transistor, and a second input coupled to the current mirror portion for generating a band gap reference voltage.

19. A bandgap reference circuit as in claim 18 in which the resistance of the first resistor is larger than the second resistor.

20. A bandgap reference circuit as in claim 18 in which the size of the first diode is large than the size of the second diode.

* * * * *

UNITED STATES PATENT AND TRADEMARK OFFICE

CERTIFICATE OF CORRECTION

PATENT NO. : 6,815,941 B2
DATED : November 9, 2004
INVENTOR(S) : Douglas Blaine Butler It is certified that error appears in the above-identified patent and that said Letters Patent is hereby corrected as shown below:

Column 8,
Line 29, "band gap" should be -- bandgap --

Signed and Sealed this

Eighth Day of March, 2005

JON W. DUDAS
*Director of the United States Patent and Trademark Office*